United States Patent [19]

Farina

[11] Patent Number: 4,589,374

[45] Date of Patent: May 20, 1986

[54] SPIRAL CORRUGATED CORROSION RESISTANT HEAT EXCHANGER

[75] Inventor: Alfred J. Farina, Baldwin, N.Y.

[73] Assignee: Thermocatalytic Corp., Williston Park, N.Y.

[21] Appl. No.: 730,388

[22] Filed: May 6, 1985

[51] Int. Cl.[4] ..... F22B 5/00

[52] U.S. Cl. ..... 122/14; 122/250 R; 122/367 C

[58] Field of Search ..... 122/14, 18, 250 R, 367 C, 122/134; 165/163

[56] References Cited

U.S. PATENT DOCUMENTS 544,152 8/1895 De Benjumea ..... 122/134

4,442,799 4/1984 Craig et al. ..... 122/250 R 4,449,485 5/1984 Tan ..... 122/367 C X

*Primary Examiner*—Edward G. Favors

*Attorney, Agent, or Firm*—Bauer & Amer

[57] ABSTRACT

A heat exchanger is formed of a pair of concentrically arranged cylindrical shells, closed at each end to define a chamber through which water can pass. A combustion element extends into the inner shell from one end along the axis thereof and is connected to a source of heat such as a gas/air mixture which ignites in the combustion element causing the radiation of heat outwardly from the combustion element. The inner shell is formed of a corrugated wall which may be formed as a single corrugation comprising a continuous helix along the length thereof or a plurality of undulations extending along the length of the cylinder.

1 Claim, 4 Drawing Figures

SPIRAL CORRUGATED CORROSION RESISTANT HEAT EXCHANGER

BACKGROUND OF THE INVENTION

The present invention relates to an radiant heated-water boiler and in particular to an improved heat exchanger therefor.

In prior, U.S. Pat. No. 4,442,799, of which the prsent applicant is a co-inventor, a radiant heated-water boiler is disclosed having a heat exchanger comprising a cylindrical shell, in which a gas fired combustion element is concentrically disposed. The combustion element is connected to a heat source, such as a gas/air mixture, which ignites the combustion element, the ignited gases passing through the element into the surrounding hollow shell. Disposed at a clearance position, about the combustion element is a helically coiled tube, through which water is pumped, which water thus absorbs the heat from the combustion element.

While this construction is highly effective and more efficient than those heat exchange arrangements previously known, several disadvantages have become known. For example, the use of a helically coiled tube increases the cost of the heat exchanger due to its complexity, labor intensiveness, and cost of basic raw material, such as the copper needed for the tube. In addition, the exchange of heat is based solely on radiation and convection impinging on the tube to heat the water in the tube. Further, only a limited through-put of water is possible, since the water had to pass serially through the spiral tube.

It is an object of the present invention to provide a heat exchanger for use in a radiant heated-water boiler which is simpler in construction than those known heretofor and which provides improved efficiency in operation.

It is a particular object of the present invention to provide a heat exchanger for use in radiant heated-water boilers in which heat transfer is effective by conduction as well as by convection.

These objects as well as other objects, features and advantages will be more fully appreciated from the following disclosure of the presently preferred but nevertheless illustrated embodiments.

SUMMARY OF THE INVENTION

According to the present invention, a radiant heated-water boiler is provided having a heat exchanger formed of a pair of concentrically arranged cylindrical shells, closed at each end to define therebetween a chamber for holding a fluid. An inlet to the chamber extends through the outer shell at one end and an outlet therefrom at the other end. A combustion element extends into the inner shell from one end along the axis thereof and is connected to a source of heat such as a gas/air mixture which ignites in the combustion element causing the radiation of heat outwardly from the combustion element. The inner shell is formed of a corrugated wall. Preferably the wall may be formed as a single corrugation comprising a continuous helix along the length thereof, having one end of the helix in communication with the inlet and the other end of the helix in communication with the outlet. In another form, the corrugations can be accordion-like, with the undulations going about the periphery of the shell with the grooves and ridges extending the length of the shell.

Preferably the heat exchanger is provided with a gas cooling or exhaust element in the form of a plug arranged along the central axis in opposition to the combustion element. The exhaust element may be ceramic, in which case, the inner tip will glow and further enhance radiation while at the same time regulating the passage of the exhaust gases. The plug may also be made of metal.

Full details of the present invention are set forth in the following description and illustrated in the accompanying drawing.

DESCRIPTION OF THE INVENTION

Figure 1:
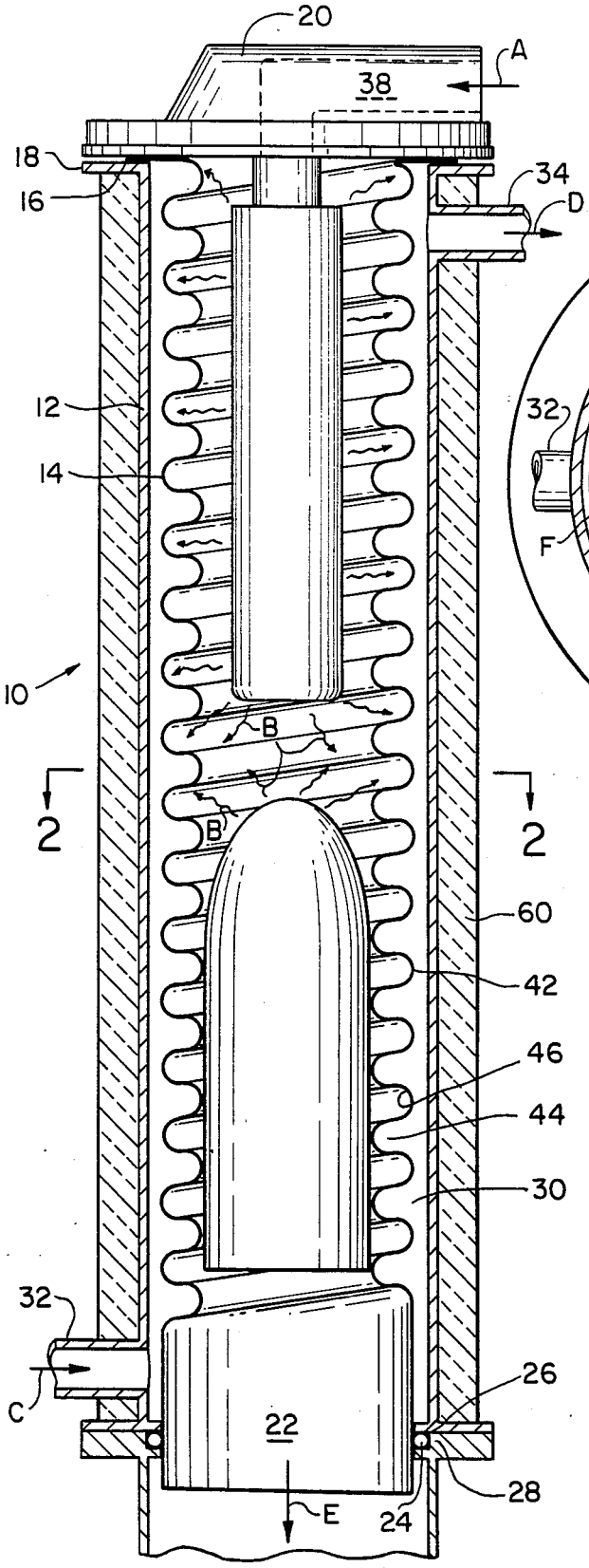
FIG. 1 is a partial section through the length of the heat exchanger embodying the present invention.
Figure 2:
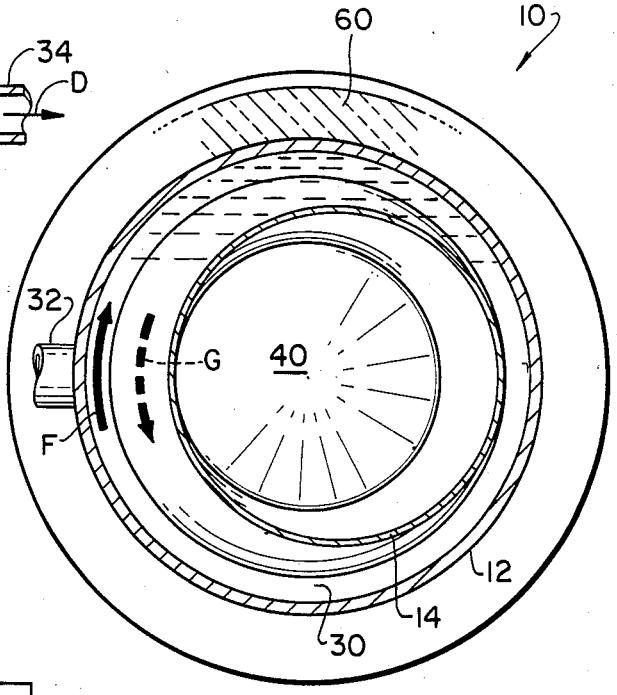
FIG. 2 is a transverse section through the heat exchanger taken along line 2—2 of FIG. 1.

As seen in FIGS. 1 and 2, the heat exchanger generally dipicted by numberal 10, comprises an outer cylindrical shell 12 and an inner cylindrical shell 14, concentrically spaced from each other. The upper end of the inner shell 14 is flared outwardly to form a radial flange 16 adapted to overlay a corresponding flanged end 18 of the outer shell. Secured to the flange 18 of the outer shell is a cap 20 which holds the inner shell 14 in a fixed position. The lower end of the inner shell comprises a smooth cylindrical footing 22 which is force fit with an O-ring seal 24 seated in an annular groove 26 formed in a radially inwardly directed flange 28 at the lower most end of the outer shell 12. In this manner, the inner shell 14 is sealed at its lower end by the O-ring 24, and at its upper end by the cap 20, so that it extends concentrically within the outer shell 12, defining therewith a closed annular chamber 30 along its entire length, in which water to be heated may be located.

An inlet 32 is provided for cooled water passes through the outer shell 12 adjacent its lower end and an outlet 34 for heated-water passes adjacent its upper end.

The present invention differs from the prior device in providing a double shell heat exchanger, the inner shell being formed of a single metallic cylinder, which as will be described has a distinctive configuration. As seen in the FIGS. 1–3, the inner shell 14 comprises a single wall 42 in which a single corrugation, accordion-like along the longitudinal axis, and consisting of a continuous helix from one end to the other is formed. Thus, both the outer and inner surfaces of the wall 42 in longitudinal section have continuous undulations; the outer surface helix 44 being completely in contact with the water in the chamber 30; the inner surface helix 46 being completely open for impingement of the incendiary gas and its radiation B. Concomitantly, the outer helix 44 provides an upward helically path F for the water flow, with a long dwelling time in the chamber, while the inner helix 46 simultaneously provides a helical countercurrent downward path G for the exhaust gases.

A porous combustion element 36 is appropriately mounted in a central clearance position within the inner shell and communicates through a supply duct 38 passing through the cap 22 with a source of combustible gas, which is forced under pressure, arrow A into the combustion element 36 and through the porosity of its wall construction so that it radiates radially therefrom as noted by the arrows individually and collectively designated B.

As understood, and as described in detail in the referred-to U.S. Pat. No. 4,442,799, the operation of the combustion element 36 contemplates igniting the combustion gases with the result that at, or near, the periphery of the surface of element 36 there is the referred-to combustion reaction that is manifested by incandescence. As a result, the radially flowing exhaust gases B are at an elevated temperature with which it is highly desirable to effectuate a heat transfer to a flowing heat exchange fluid, such as water.

To the above end, the heat exchanger 10 also includes a source of water that is pumped through a pipe or conduit (not shown) into the inlet 32 such that a continuous stream of water exits through the outlet 34 after a sufficient period of dwelling time within the chamber 30 such that its temperature is significantly elevated as compared with the temperature at which it entered.

A plug 40, made of ceramic porous material is forced, fitted or otherwise mounted tightly within the inner shell at the lower or remote end from the combustion element, so as to prevent the rapid escape of the incendiary exhaust gases from the inner shell 14. The plug 40 on the other hand regulates the escape of the gas, while at the same time acting to cool the gas prior to its escape. In cooling the incendiary gas, the plug 40, itself becomes hot and glows, at its tip, adding to the heat within the inner shell. The gas is cooled as it passes around the plug 40 and exits through the open lower end 22 of the inner shell, as seen by arrow E.

Although the structure described is different from that described in my earlier mentioned patent, the basic operation of the heat exchanger is similar so that further details of the combustion element, plug, and water flow will be apparent to those skilled in this art.

Figure 3:
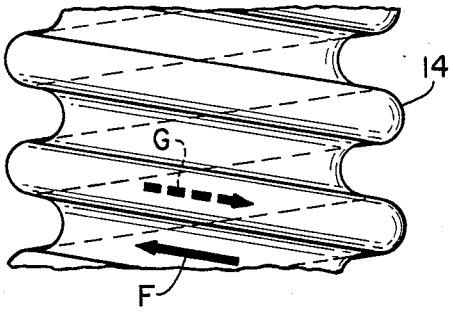
FIG. 3 is an enlarged portion of the helical corrugated inner shell.

As has already been noted, the present invention differs from the prior device in providing a double shell heat exchanger, the inner shell being formed of a single metallic cylinder, which as described has a distance configuration. As seen in FIGS. 1-3, it will be recognized that during operation the fluid flow rate is such that the entire chamber 30 formed between the inner and outer shells is filled with the fluid, passing in contact with the outer surface of the helically corrugated inner shell, effecting heat conduction, with the entire surface. Simultaneously, the inner surface of the corrugated inner shell provides an enlarged area against which the radiant heat may impinge. As a result the entire body of water in the chanber 30 is subject to heat transfer at all times.

Among other noteworthy advantages obtained by the present invention are the following: The construction of the heat exchanger has been simplified by the use of a relatively large dimensioned inner shell rather than the small diameter helical tube; the surface adjacent to the radiant combustion element has been increased significantly due to the accordion-like corrugated surface and therefore more radiant heat is transferred to the fluid being heated, and similarly, the surface against which the water resides is also increased by the accordion-like structure; heat transfer occurs due to both convection and conduction and the transfer is more direct because the water surfaces are correspondingly in direct contact with the heating media; during operation, there is turbulent helical flow of the radiant and exhaust gases which increases heat transfer, as seen in FIG. 2 where it is clear that the water helix spirals radially in one direction while the gas helix spirals radially in the other direction, so that the water and gas in adjavent axial layers is in constant movement with respect to each other; the fluid to be heated takes a helical flow pattern and is thus turbulent, thereby reducing the effect of the insulating boundary layer generally caused in smooth helical tubes, and provides a higher heat transfer; and heat transfer is also enhanced by the fluid flow counter to the radiant heat and exhaust gases.

The advantages enumerated above are in large measure obtained because of the increased surface space for both water and gas contact, providing an increased dwell time under conditions of heat transfer, while simultaneously providing means for directing the flow of liquid and incendiary gas in counterflow direction. Such an advantage can also be obtained by constructing the inner shell so that the accordion-like corrugations run generally longitudinal. This form is seen in FIG. 4, where similar parts bear similar reference numerals.

Figure 4:
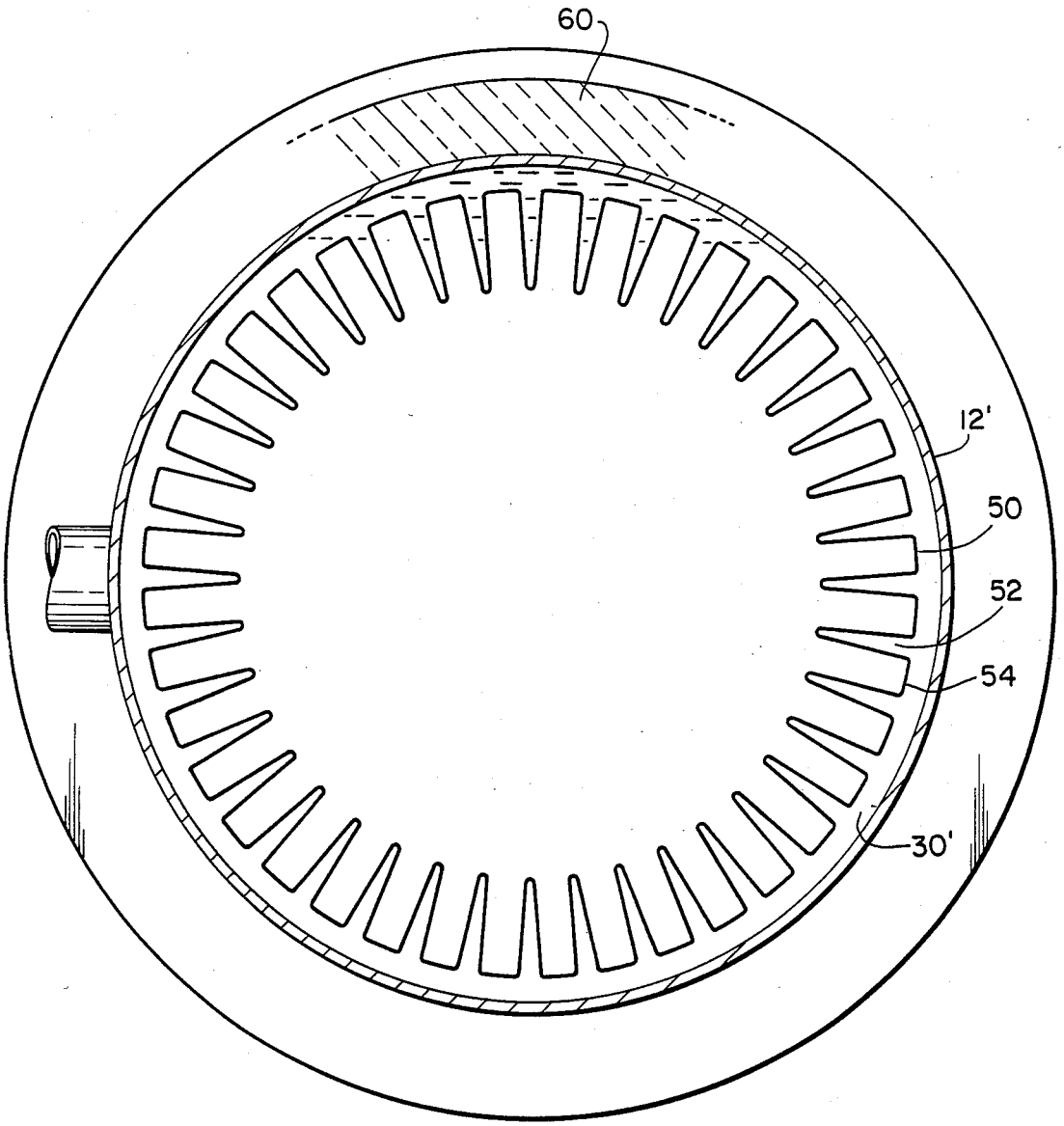
FIG. 4 is a view similar to that of FIG. 3 showing another form of the invention.

In FIG. 4, the inner shell 50 is provided with parallel corrugations circumferential about the entire shell. Each corrugation has an outwardly open-inner directed undulation 52, of narrow triangular shape, and a generally rectangular undulation 54 which is inwardly open but outwardly directed. The narrow triangular undulation forms with the outer shell 12', the water chamber 30' while the rectangular undulation faces the combustion element and forms the wall of the heat chamber. The triangular and rectangular shapes of the undulations 52 and 54 respectively have been chosen for convenience, since such shapes permit the formation of the corrugations in a flat sheet which can then be bent to form the cylindrical shell, without distortion. Other forms of the undulations can be employed. In addition, a slight helical curve can be given the undulations from top to bottom if desired, so that the liquid and gas flow somewhat spirally about the central axis.

In any event, the desired increase in surface area for heat exchange and directional flow is obtained by the embodiment shown in FIG. 4.

Preferably, the heat exchanger is completed by enclosing the outer shell with a layer of insulation abutting the outer surface of the outer shell 12. A surrounding decorative housing, not shown, may be provided.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A heat exchanger for a radiant heated water boiler comprising a pair of concentrically arranged cylindrical shells, each formed of a single continuous helix extending from one end thereof to the other and closed at each end to define therebetween a chamber for holding water, an inlet for the supply of water to said chamber extending through the outer shell at one end and an outlet for the discharge of water therefrom at the other end, a combustion element extending into the inner shell from said other end providing a source of heat radiating outwardly therefrom against the inner shell, said inner shell being formed of a corrugated wall, said helix being formed with an angular orientation so that the water in said chamber is caused to flow therein in an upward direction and said radiated source of heat is caused to flow downwardly along the interior surface of said inner shell, and a porous plug arranged in the one end of said inner shell to regulate the exhaust of said heat source therethrough.

* * * * *